United States Patent [19]

Wischusen, III

[11] 4,410,129

[45] Oct. 18, 1983

[54] COLLAPSIBLE PAPERBOARD CONTAINER

[75] Inventor: Henry Wischusen, III, Lilburn, Ga.

[73] Assignee: Rock-Tenn Company, Norcross, Ga.

[21] Appl. No.: 316,951

[22] Filed: Oct. 30, 1981

[51] Int. Cl.[3] ..... B65D 5/36; B65D 5/42

[52] U.S. Cl. ..... 229/41 B; 229/1.5 B; 229/4.5

[58] Field of Search ..... 229/1.5 B, 37 R, 41 R, 229/41 B, 4.5

[56] References Cited

U.S. PATENT DOCUMENTS

| | | | |
|---|---|---|---|
| 2,067,998 | 1/1937 | Williamson | 229/41 B |
| 2,740,576 | 4/1956 | Franck | 229/41 B |
| 2,787,408 | 4/1957 | Andre | 229/41 B |

*Primary Examiner*—Herbert F. Ross

*Attorney, Agent, or Firm*—Jones & Askew

[57] ABSTRACT

An open-ended collapsible paperboard container includes front and back wall panels, and side wall panels tapering to a bottom edge joining the front and back wall panels. In one embodiment of the invention, the side wall panels widen from the bottom edge to a location less than half the distance to the top of the container, and extend therefrom at essentially the same width to the top of the container. In a second embodiment of the invention, the side wall panels comprise diamond-shaped scores which bow inwardly, the diamond-shaped scores encompassing less than one-half the height of the container.

4 Claims, 11 Drawing Figures

COLLAPSIBLE PAPERBOARD CONTAINER

TECHNICAL FIELD

The present invention relates to paperboard containers formed from appropriately cut and scored flat blanks, and more particularly relates to a collapsible open-ended container useful for holding french fried potatoes and the like.

BACKGROUND ART

In "fast food" restaurants, french fried potatoes are typically served in open-ended containers. The most economical container has been the open-ended paper bag, which can be held open and filled with a well-known metal scoop, and temporarily stored in a sawtooth-shaped rack. However, paper bags are subject to tearing and can be difficult to handle because of their flimsiness.

Open-ended paperboard containers have also been provided to hold french fried potatoes. U.S. Pat. Nos. 2,966,293; 3,630,430; 3,684,157; 3,845,897; 3,877,632 and 4,185,764 show containers which can be snap-erected and remain erected because of inwardly-bowing bottom or sidewall panels. While some such containers have been relatively easy to erect and others can stand erect without support, prior art configurations have had various disadvantages such as not being adapted for temporary storage in typical sawtooth racks, or using a relatively large amount of paperboard to provide full side or bottom panels, or creating long, unsealed cut joints at the bottom portion of the container through which grease or granular product coatings could escape. When such long unsealed joints are present, the problem of leakage can be exacerbated if the contents of the container press against its walls in a manner which tends to collapse the container, thus creating gaps at the joints. A further disadvantage in the containers shown in U.S. Pat. Nos. 3,845,897 and 3,877,632 is that the center or "break point" of the inwardly-bowing side wall panels is midway along the height of the container. This configuration leaves the container vulnerable to pressure from product within the container which may tend to collapse the container. In the case of both of these prior patents, such collapsing would create gaps at the bottom of the container and increase the possibility of leakage, as noted above.

SUMMARY OF THE INVENTION

The present invention provides a collapsible open-ended paperboard container which is constructed from a minimal amount of paperboard, can be easily erected and is self-locking in an erected position, minimizes the possiblity of leakage of product from the container, is resistant to collapse from the pressure of product within the container, can be temporarily stored in a sawtooth rack, and provides sufficient volume for the product without full width bottom and side panels.

Generally described, a collapsible paperboard container embodying the present invention comprises front and back wall panels each having top edges, bottom edges joined together and a pair of side edges; a pair of side wall panels each joined to the side edges of one of the front wall panels and one of the back wall panels by a scored hinge along the entire length of the side edges, the side wall panels being shaped to maintain the front and back wall panels in spaced apart relationship such that the side edges of the front and back wall panels joined by a side wall panel extend substantially parallel to one another from the top edges for a portion of the height of the side wall panels, said side wall panels then tapering such that said side edges bend inwardly to meet one another at the point at which the bottom edges of the front and back wall panels are joined, and the side wall panels further including a central longitudinal score; the side edges of the front wall panel converging, in the plane of the front wall panel, toward one another from the top edge of the front wall panel to the location at which the side wall panels begin to taper, and then diverging from one another to the bottom edge of the front wall panel; and the side edges of the back wall panel converging, in the plane of the back wall panel, toward one another from the top edge of the back wall panel to the location at which the side wall panels begin to taper, and then diverging from one another to the bottom edge of the back wall panel. The container preferably further comprises weakening scores in the side wall panels extending upwardly, from the locations at which the side wall panels begin to taper, to the central longitudinal score so as to form the shape of a diamond with the tapering portion of the side wall panels. The location at which the side wall panels begin to taper and the side edges begin to bend, the "break point", is preferably located below the midway point of the height of the side wall panels.

The invention also comprises a blank for forming such a collapsible paperboard container, the blank being cut and scored such that the container is originally formed as a flattened assembly folded along the central score lines of the side wall panels. The container is erected by applying inward pressure to the folded side wall panels. When erected, the profile of the side wall panels is a strip having a point formed at the bottom portion thereof, terminating at the bottom edge of the container.

The invention further comprises, in a second embodiment, a collapsible container including a front wall panel and a back wall panel joined along bottom edges thereof and along side edges thereof; the front and back wall panels including identical pairs of "V" shaped weakening scores opening to the side edges; and the container being erectable by pressure applied inwardly at the location of the "V" shaped scores to form a pair of diamond-shaped side panels extending less than half the length of the side edges of the front and back wall panels. The diamond-shaped side panels are preferably positioned adjacent to the bottom edges of the front and back wall panels. The invention also comprises a blank for forming the container according to the second embodiment of the invention.

Thus, it is an object of the present invention to provide an improved open-ended collapsible paperboard container.

It is a further object of the present invention to provide a collapsible open-ended paperboard container formed from a minimal amount of paperboard.

It is a further object of the present invention to provide a collapsible paperboard container that can be erected and is resistant to collapse from the pressure of product placed into the container, and minimizes the possibility of leakage from thecontainer.

It is a further object of the present invention to provide a collapsible paperboard container tapering to a bottom edge suitable for storage in a sawtooth rack.

It is a further object of the present invention to provide a collapsible open-ended paperboard container having diamond-shaped scores which form side wall portions encompassing less than the entire height of the container.

Other objects, features and advantages of the present invention will become apparent upon reading the following detailed description of embodiments of the invention, when taken in conjunction with the drawing and the appended claims.

DETAILED DESCRIPTION

Figure 1:
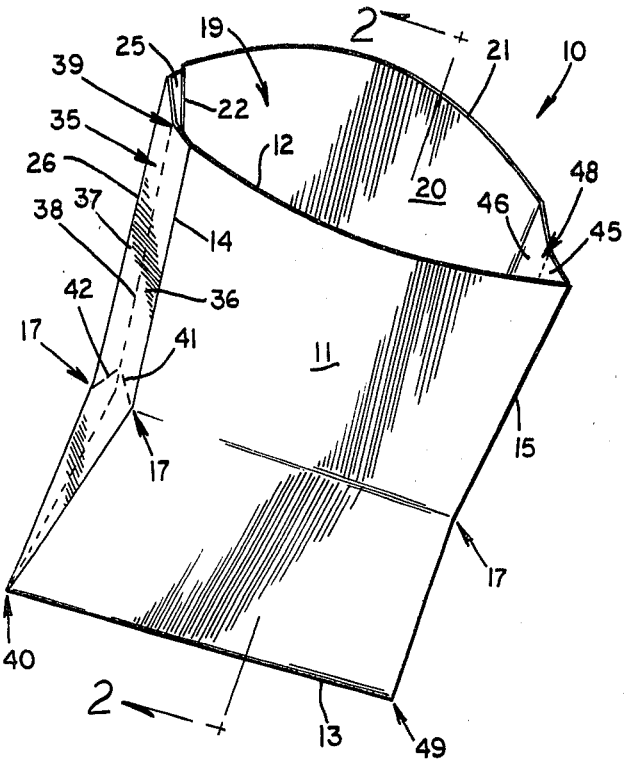
FIG. 1 is a pictorial view of an erected paperboard container embodying the present invention.
Figure 3:
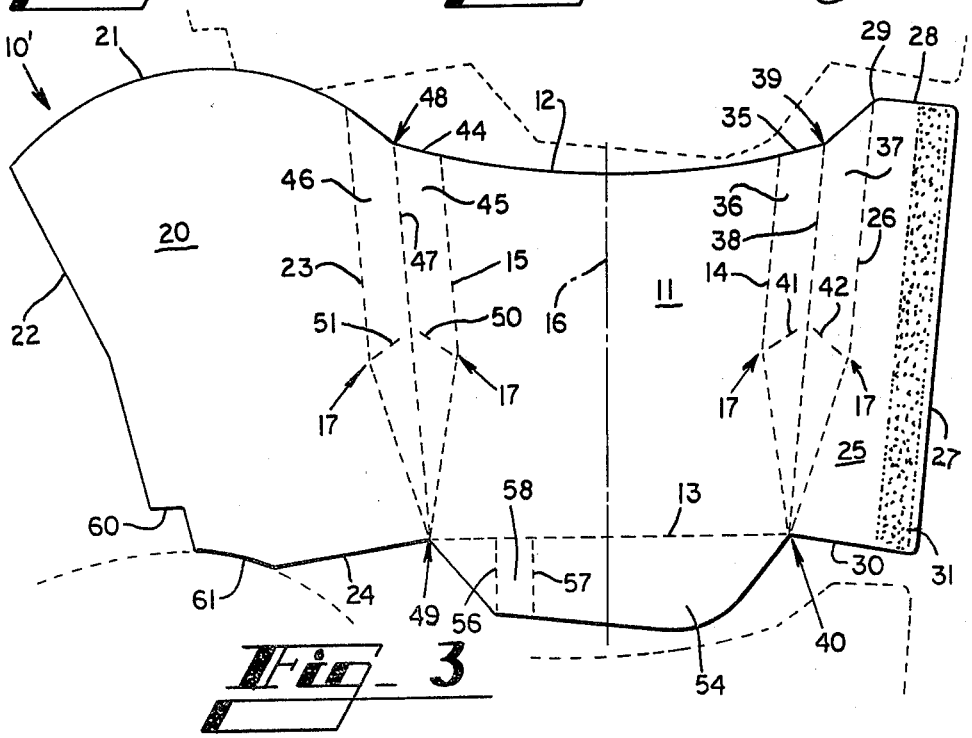
FIG. 3 is a plan view of a cut and scored paperboard blank from which the container shown in FIG. 1 can be formed.

Referring now to the drawing, in which like numerals represent like parts throughout the several views, FIG. 1 shows an erected open-ended paperboard container 10 embodying the present invention. A blank 10' for forming the container 10 is shown in FIG. 3. The container 10 includes a front wall panel 11 which has an upwardly concave top edge 12, a linear bottom edge 13 formed by a score line, a left side edge 14 formed by a score line, and a right side edge 15 formed by a score line. The vertical centerline of the front wall panel 11 is represented by a dashed line 16 in FIG. 3. The left and right side edges of the front wall panel are symmetrical about the centerline 16. The side edges 14 and 15 converge toward one another from the top edge 12 to points 17, which are preferably located more than half the distance from the top edge 12 toward the bottom edge 13. From the points 17, the side edges 14 and 15 diverge from one another until they intersect the bottom edge 13. Alternately, the side edges 14 and 15 can be continuous curves converging toward one another and then diverging until they intersect the bottom edge 13.

The container 10 also includes a back wall panel 19 which, in the assembled container, includes a back wall flap 20 and a back glue flap 25. The back wall flap 20 includes an upwardly convex top edge 21, a cut left side edge 22, a right side edge 23 formed by a score line, and a cut bottom edge 24 angled with respect to the centerline 16 so as to be parallel to the bottom edge 13 of the front wall panel when folded in the manner described below.

The back glue flap 25 includes a left side edge 26 formed by a score line, a cut right side edge 27, a cut top edge 28 and a cut bottom edge 30 angled with respect to the centerline 16 so as to be parallel to the bottom edge 13 of the front wall panel 11 when the blank 10' is folded in the manner described below. Prior to assembly of the blank 10', a linear strip of glue 31 is applied to the surface of the back glue flap 25 adjacent to the side edge 27 by a straight line gluer. The top edge 28 of the back glue flap 25 includes a curved portion 29 immediately adjacent to the side edge 26, the curved portion 29 matching the curvature of the top edge 21 of the back wall flap 20.

The container 10 also includes a pair of side wall panels 35 and 44. The left side wall panel 35 includes a front half 36 and a back half 37 separated by a a central score 38 which extends from a point 39 at the top of the container spaced outwardly from the side edge 14 of the front wall panel 11, to a left bottom corner 40 formed at the intersection of the edges 13, 14, 26 and 30. The side wall half panel 36 includes a perforated weakening score 41 extending on an upward angle from the point 17 along the side edge 14 to the central score 38. The back half side panel 37 includes a similar perforated score 42 symmetrical about the score line 38 extending from the point 17 on the edge 26 upwardly toward the central score line 38. It will thus be seen that a diamond shape is formed in the bottom portion of the left side panel 35 by the weakening score lines 41 and 42, together with the portions of the score lines 14 and 26 below the points 17.

The right side wall panel 44 extends between the side edges 15 and 23 of the front and back wall panels 11 and 19, respectively. The side wall panel 44 includes a front half panel 45 and a back half panel 46 separated by a central score line 47, which extends between a point 48 along the top edge of the container 10 spaced outwardly from the side edge 15 of the front wall panel 11 to a right bottom corner 49 located at the intersection of the edges 13, 15, 23 and 24. The front half panel 45 includes a perforated weakening score 50 extending from the point 17 along the side edge 15 upwardly toward the central score 47. The back half panel 46 includes a similar perforated score 51 extending from the point 17 along the side edge 23 upwardly toward the central score 47 and symmetrically with the score 50 about the central score 47. It will be seen that the weakening scores 50 and 51 form a diamond-shaped panel in the lower portion of the side wall panel 44 with the lower portions of the side edges 15 and 23.

It will further be seen on the blank shown in FIG. 3 that the side wall panels 35 and 44 are mirror images of one another symmetrically placed with respect to the centerline 16. Each of the side wall panels is generally shaped to maintain the front and back wall panels in spaced apart relation such that the side edges 14 and 26, and the side edges 15 and 23, extend downwardly essentially parallel to one another to the points 17, and then taper or converge toward one another to the bottom corners 40 and 49.

Figure 8:
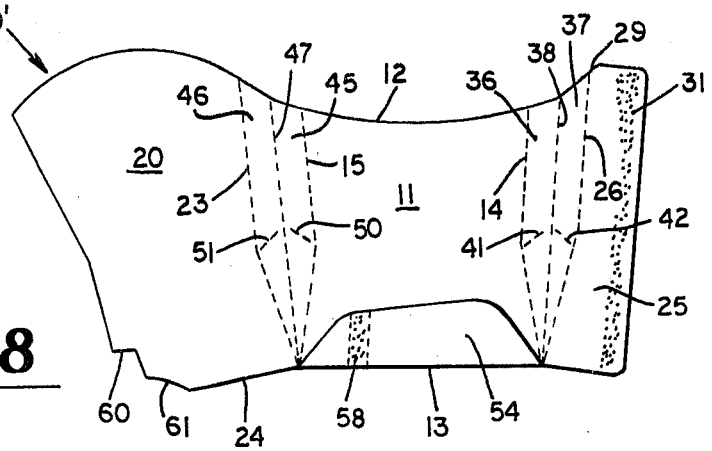
FIGS. 8, 9 and 10 show an assembly sequence by which the blank of FIG. 3 is formed into a flat assembly which can be erected to form the container of FIG. 1.

The container 10 also includes a bottom glue flap 54 which extends downwardly from the bottom edge 13 of the front wall panel 11. A pair of parallel scores 56 and 57 extend downwardly from the bottom edge 13 to form a slightly raised portion 58 in the opposite side of the bottom glue flap 54 shown in FIG. 3, for receiving glue. The score lines 56 and 57 are angled with respect to the centerline 16 such that when the bottom glue flap 54 is folded upwardly, as shown in FIG. 8, the raised portion 58 is parallel to the glued strip 31 on the back glue flap 25. This facilitates simultaneous application of glue to the area 31 on the side of the blank showing in FIG. 3, and to the opposite side of the portion 58 shown in FIG. 3.

In order to permit the glued area 31 of the back glue flap 25 to contact the bottom glue flap 54, a cutout 60 can be made from the lower corner of the back wall flap 20. Adjacent to the cutout 60, an outwardly concave cutout 61 is preferably made to accomodate nesting of an identical blank 10' to reduce paperboard waste in producing the blanks from sheets of paperboard. Nested adjacent blanks are shown in dashed lines in FIG. 3.

In the preferred embodiment shown in FIG. 3, the score lines 13, 14, 15, 23, 26, 38 and 47 are cut scores, whereas the score lines 56 and 57 are creased scores. Particular angular relationships are preferred in the manufacture of the blank 10'. The central score 38 is preferably angled at about 5° from the centerline 16. The upper portion of the score 14 above point 17 is angled at about 6 ½°, and bottom portion at about 10°, from the centerline 16. Thus, the angle between the central score 38 and the lower portion of the score 14 is about 15°, and the angle defined by the side wall panels 35 and 44 as they approach the bottom edge 13 is about 30°. Similar relationships to those described hold for the scores 15 and 47.

Figure 9:
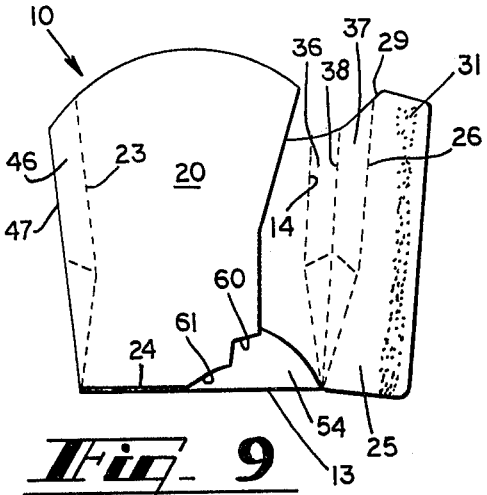
Figure 10:
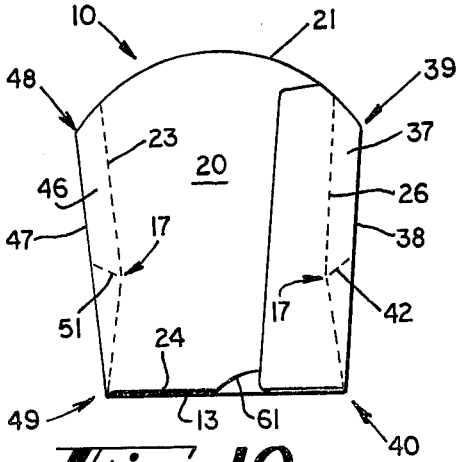

In order to form a container 10 from a blank 10', the sequence of steps shown in FIGS. 8, 9 and 10 is carried out, preferably on well-known paperboard box folding and gluing machinery. The first step, shown in FIG. 8, is to fold the bottom glue flap 54 about the score line 13 until it lies against the front wall panel 11. Then, glue is applied to the area 31 and to the area 58. Next, as shown in FIG. 9, the back wall flap 20 and back half 46 of the side wall panel 44 are folded about the central score 47 to lie against the bottom glue flap 54 and the front wall panel 11. The back wall flap 20 adheres to the glue applied to the area 58 of the bottom glue flap 54. The bottom edge 24 of the back wall flap 20 is angled such that it lies parallel and along the bottom edge 13 after the fold along the score 47. Next, as shown in FIG. 10, the back glue flap 25 and the back half panel 37 of the left side wall panel 35 are folded about the central score 38 against the front wall panel 11. The glued area 31 adheres to the back wall flap 20, and to the bottom glue flap 54 where it is exposed by the cutout 60. The foregoing steps complete assembly of the collapsed container 10. In this flat, collapsed form, the container can be efficiently shipped after manufacture. It will be noted that after assembly, as shown in FIG. 10, the side edges 23 and 26 of the back wall flap 20 and back glue flap 25, respectively, are symmetrical about the centerline of the container, and converge toward one another to points 17, and then diverge to the bottom corners 40 and 49, in a manner similar to the positioning of the side edges 14 and 15 of the front wall panel 11.

Figure 2:
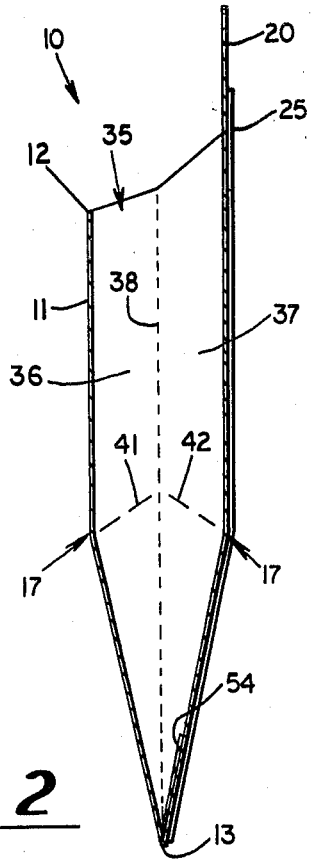
FIG. 2 is a vertical cross-sectional view of the container of FIG. 1, taken along line 2—2 of FIG. 1.

When the container 10 is to be erected for use, the assembly shown in FIG. 10 is grasped along the sides thereof opposite the points 17, and pressure is applied inwardly. Such pressure causes the side wall panels 35 and 44 to bow inwardly and to break in the area of the weakening scores 41 and 42, for the left side panel 35, and in the area of weakening scores 50 and 51, for the right side wall panel 44. The weakening scores 41, 42, 50, 51 define a diamond-shaped portion in the lower portion of the side wall panels, as shown in FIGS. 1 and 2, and also promote outward bowing of the side wall panels above the points 17. Since the points 17 are located closer to the bottom edge 13 than to the top of the carton, the carton is less likely to be collapsed by the pressure of product packed within the container. The low position of the points 17 also provides for a relatively long full width portion of the container, even though the container is tapered to a bottom edge 13 so that it can be received within sawtooth storage racks typically used in the cooking and packaging of french fried potatoes.

Figure 4:
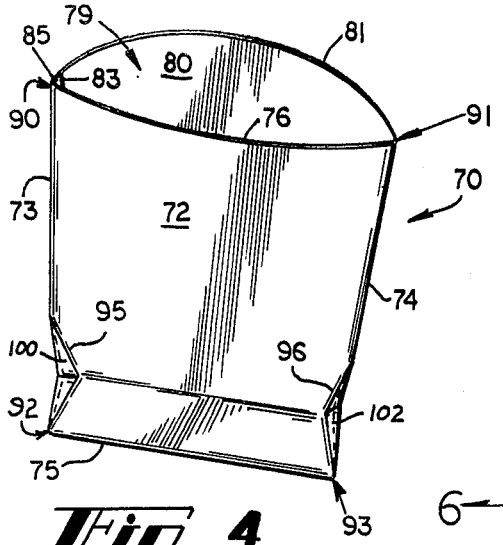
FIG. 4 is a pictorial view of a second embodiment of the present invention in an erected paperboard container.
Figure 6:
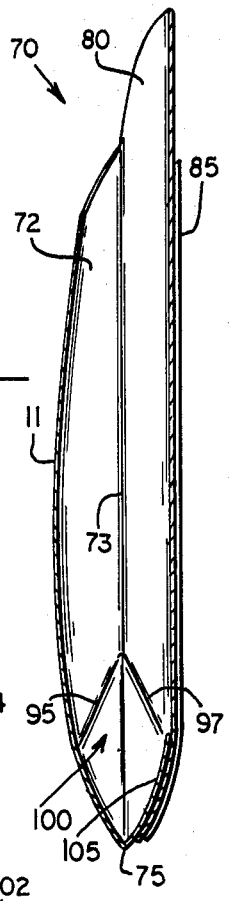
FIG. 6 is a vertical cross-sectional view of the second embodiment of the invention taken along line 6—6 of FIG. 5.
Figure 5:
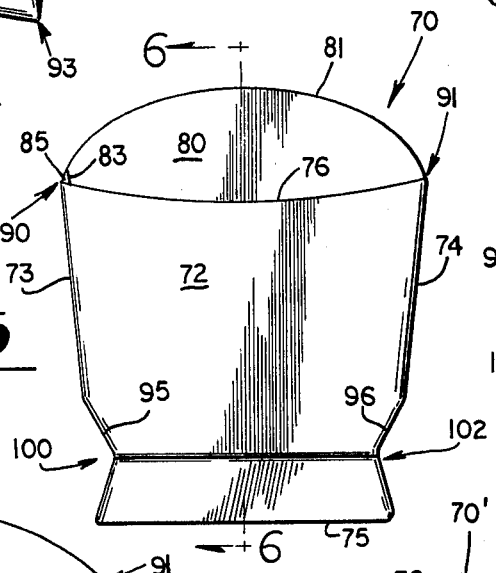
FIG. 5 is a front plan view of the erected container of FIG. 4.
Figure 7:
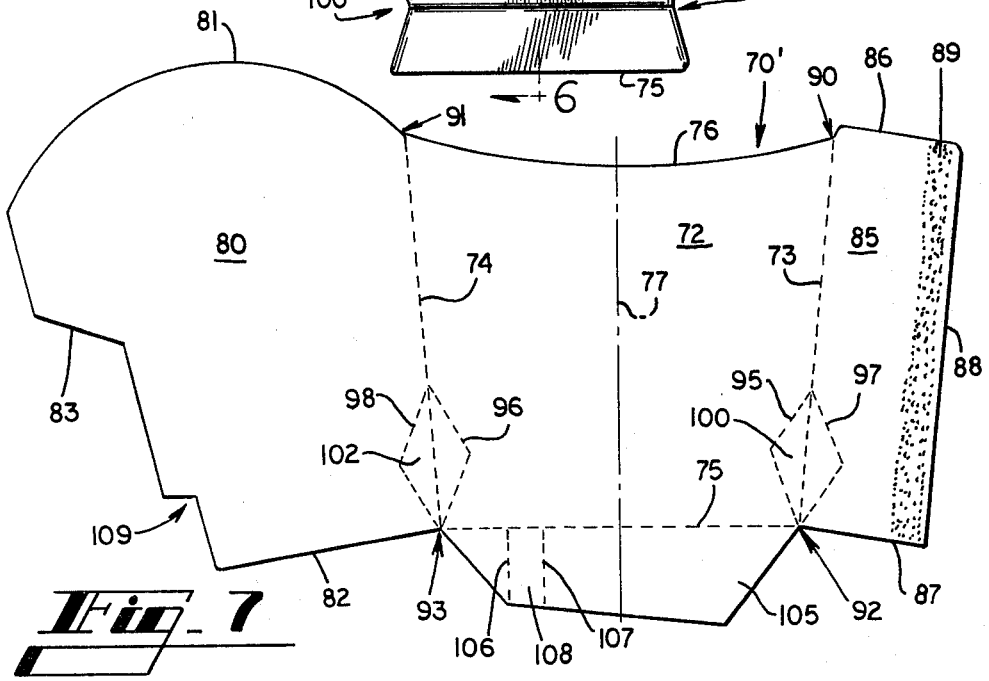
FIG. 7 is a plan view of a cut and scored paperboard blank from which the container of FIG. 4 can be formed.

A second embodiment of the present invention in a paperboard container 70 is shown in FIGS. 4–6, in its erected form. A blank 70' for forming the carton 70 is shown in FIG. 7. The open-ended collapsible container 70 includes a front wall panel 72 which includes a left side edge 73 formed by a score line, a right side edge 74 formed by a score line, a bottom edge 75 formed by a score line, and a cut upwardly concave top edge 76. The side edges 73 and 74 are symmetrical about a vertical centerline 77 drawn through the front wall panel 72 in FIG. 7, and converge slightly toward one another from the top to the bottom of the container 70.

The container 70 also includes a back wall panel 79 including a back wall flap 80 and a back glue flap 85 which are assembled to form the back wall panel 79. The back wall flap 80 includes an upwardly convex cut top edge 81, a cut bottom edge 82 angled to lie parallel to the bottom edge 75 of the front panel 72 when folded, and a cut left side edge 83. The right side edge of the back wall flap 80 is formed by the score line 74 which is also a side edge of the front wall panels 72. The back glue flap 85 includes a cut top edge 86, a cut bottom edge 87 angled to lie parallel to the bottom edge 75 when folded, and a cut right side edge 88. The left side edge of the flap 85 is formed by the score line 73 which also forms the left side edge of the front wall panel 72.

In assembly, glue is applied in an area 89 which extends in a longitudinal strip adjacent to the right side edge 88 of the back glue flap 85.

In the assembled carton 70 shown in FIGS. 1 and 2, the front wall panel 72 and the back wall panel 79 are joined together along the score lines 73 and 74 and form a left upper corner 90, a right upper corner 91, a left lower corner 92 and a right lower corner 93. The front wall panel 72 further includes a pair of "V" shaped score lines 95 and 96 which are symmetrical about the centerline 77 and "open" to the side edge score lines 73 and 74, respectively. The lower arms of each "V" intersect the lower corners 92 and 93, respectively. Similarly, the back wall panel 79 includes a pair of "V" shaped scores 97 and 98 symmetrical about the centerline 77 and opening to the score lines 73 and 74, respectively. The lower arm of each "V" intersects the lower corners 92 and 93, respectively. Thus, the score lines 95 and 97 define a left side wall panel 100 in the shape of a diamond adjacent to the bottom of the carton and having a lower acutely angled point positioned at the lower corner 92 of the carton, and an upper acutely angled point positioned along the score line 73, the panel 100 encompassing less than one-half of the score line 73. Likewise, the score lines 96 and 98 form a right side wall panel 102 in the shape of a diamond identical to the side wall panel 100 and positioned symmetrically about the centerline 77 with respect thereto. The panel 102 has a lower acutely angled point positioned at the lower corner 93 of the carton, and an upper acutely angled point positioned along the score line 74.

The carton 70 further includes a bottom glue flap 105 which extends downwardly from the score line 77 defining the bottom edge of the front wall panel 72. The bottom glue flap 105 includes a pair of parallel score lines 106 and 107 extending downwardly from the score line 75 to form a raised area 108 for receiving glue, similar to the raised area 58 on the blank 10'. A cutout 109 can be formed in the back wall flap 80 to expose the bottom glue flap 105 to the glued area 89. Also, the side edge 83 can jog inwardly as shown in FIG. 7 to remove material from the back wall flap 80 and facilitate nesting of blanks.

The blank 70' shown in FIG. 7 is assembled into a collapsed container by steps essentially identical to those shown for the blank 10' in FIGS. 8–10. First, the bottom glue flap 105 is folded about the score line 75, after which glue is applied to the areas 89 and 108. Next, the back wall flap 80 is folded about the score line 74. Finally, the back glue flap 85 is folded about the score line 73. The container 70 is erected by grasping the sides of the container at the center of the "V" shaped score lines and applying force inwardly. The side wall panels 100 and 102 are formed and bow inwardly to lock the container 70 in an open position.

In the second embodiment of FIGS. 4–7, the score lines 73, 74 and 75 are preferably cut scores, and the score lines 95, 96, 97, 98, 106 and 107 are preferably creased scores.

Figure 11:
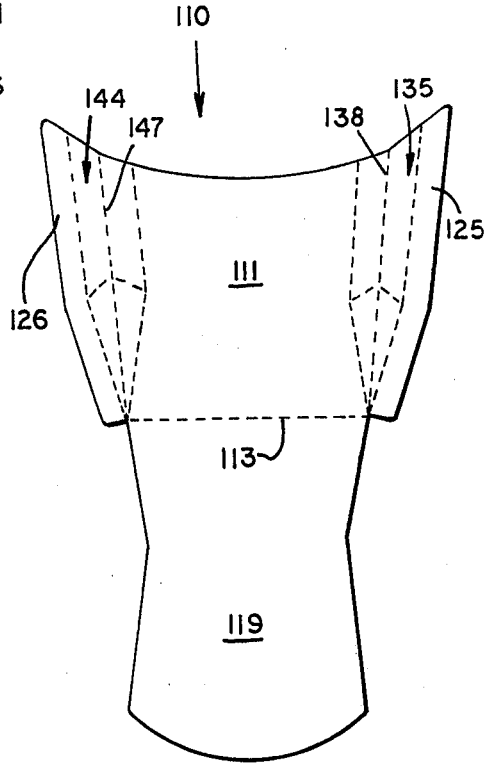
FIG. 11 is a plan view of an alternative cut and scored blank for forming the container of FIG. 1.

FIG. 11 shows an alternate shape in which a blank 110 can be shaped to form a container 10. The blank 110 includes a front wall panel 111 and a back wall panel 119 joined by a bottom edge score line 113. Side wall panels 135 and 144, identical to the panels 35 and 44 of blank 10', are attached by score lines to the sides of the front wall panel 111. Attached to the outward sides of the side wall panels 135 and 144 by score lines are glue panels 125 and 126. In order to assemble the container from the blank 110, the glue flaps 125 and 126 are folded inwardly about central score lines 138 and 147 which pass longitudinally through the center of the side wall panels 135 and 144. Next, glue is applied to the exposed sides of the glue panels 125 and 126. Finally, the back wall panel 119 is folded about the score line 113 to rest against the front wall panel 111 and adhere to the glue flaps 125 and 126.

It will thus be seen that the present invention provides a novel and improved open-ended collapsible paperboard container in which diamond-shaped side wall portions are shaped and positioned to assist in locking the container in an open position while not interfering with or substantially reducing the interior volume of the container. Furthermore, the container is resistant to collapsing as a result of pressure of product packed into the container, and does not create gaps when such product pressure tends to collapse the container. A container embodying the present invention has a tapering bottom portion which can be suitably received in a sawtooth storage rack and saves material that would be requied for full side wall panels, but does not result in unacceptable restriction of the volume of the container.

While this invention has been described in specific detail with particular reference to preferred embodiments thereof, it will be understood that variations and modifications can be effected within the spirit and scope of the invention as described in the appended claims.

I claim:

1. A collapsible paperboard container formed from a cut and scored flat blank, comprising:

front and back wall panels each having top edges, bottom edges joined together and a pair of side edges;

a pair of side wall panels each joined to said side edges of one of said front wall panels and one of said back wall panels by a score line along the entire length of said side edges, said side wall panels being shaped to maintain said front and back wall panels in spaced apart relationship such that said side edges of said front and back wall panels joined by said side wall panels extend substantially parallel to one another from said top edges for a portion of the height of said side wall panels, said side wall panels then tapering such that said side edges bend inwardly to meet at the point at which said bottom edges of said front and back wall panels are joined, said side wall panels further including a central longitudinal score and a pair of weakening scores extending diagonally upwardly, from the locations at which said side panels begin to taper, to said central longitudinal score so as to form the shape of a diamond with the tapering portions of said side wall panels;

said side edges of said front wall panel converging in the plane of said front wall panel toward one another from said top edge of said front wall panel to the location at which said side wall panels begin to taper, and then diverging from one another to said bottom edge of said front wall panel; and said side edges of said back wall panel converging in the plane of said back wall panel toward one another from said top edge of said back wall panel to the location at which said side wall panels begin to taper, and then diverging from one another to said bottom edge of said back wall panel.

2. A blank for forming a collapsible container comprising an elongate sheet of paperboard cut and scores to provide:

a front wall panel including a cut top edge, and a bottom edge and side edges defined by score lines, said side edges intersecting with said bottom edge to define bottom corners of said front wall panel, and with said top edge to define upper corners of said front wall panel;

a bottom glue panel joined by a score line to the bottom edge of said front wall panel;

a pair of side wall panels joined by a score line to the side edges of said front wall panel;

a back wall flap joined by a score line to one of said side wall panels; and a back glue flap joined by a score line to the other of said side wall panels;

said side edges of said front wall panel converging toward one another from said upper corners to a location intermediate the top and bottom edges of said front wall panel, and then diverging away from one another to said bottom corners;

said side wall panels tapering from the location at which said side edges of said front wall panel begin to diverge to a point at one of said bottom corners of said front wall panel, and further including straight central scores extending from points spaced outside the upper corners of said front wall panel to the lower corners of said front wall panel, and said side wall panels being essentially symmetrical about said central scores; and said side wall panels each including a pair of weakening scores extending diagonally upwardly from the location at which said edges begin to diverge, to said central score so as to form the shape of a diamond with the lower tapering portion of said side wall panel;

said blank being foldable into a flat erectable configuration along the score line between said front wall panel and said bottom glue panel and along said central scores of said side wall panels.

3. A blank for paperboard or the like for forming a collapsible container, comprising:

a front wall panel having a bottom edge, a top edge, and two side edges;

a bottom glue flap foldably connected to said front wall panel along said bottom edge;

a back wall flap foldably connected to said front wall panel along one of said side edges;

a back glue flap foldably connected to said front wall panel along the other of said side edges;

said back wall flap, said back glue flap and said bottom glue flap overlapping each other when folded inwardly against said front wall panel; and a pair of diamond-shaped weakening scores each positioned symmetrically about one of said side edges so as to encompass equal areas of said front wall panel and one of said back wall flap and said back glue flap, said diamond-shaped scores each defining a lower acutely angled point located at an intersection of said bottom edge and one of said side edges and an upper acutely angled point positioned along said side edge less than one-half the distance from said bottom edge to said top edge;

said diamond-shaped scores defining the only scores provided in said front wall panel, said back wall flap and said back glue flap for formation of side wall panels.

4. A collapsible container of paperboard or the like comprising:

a front wall panel having a bottom edge, a top edge and two side edges;

a back wall panel foldably connected to said front wall panel along said bottom and said two side edges; and a pair of diamond-shaped weakening scores each positioned symmetrically about one of said side edges so as to encompass equal areas of said front and back wall panels, said diamond-shaped scores each defining a lower acutely angled point located at an intersection of said bottom edge and said side edge and an upper acutely angled point positioned along said side edge less than one-half the distance from said bottom edge to said top edge;

said diamond-shaped scores defining the only scores provided in said front and back wall panels for formation of side wall panels.

* * * * *